United States Patent [19]

Smith

[11] 3,962,883

[45] June 15, 1976

[54] SLAB COMPLETION TIME DELAY RELAY

[75] Inventor: Robert Smith, Dayton, Ohio

[73] Assignee: General Motors Corporation, Detroit, Mich.

[22] Filed: July 2, 1975

[21] Appl. No.: 592,649

[52] U.S. Cl. ..... 62/137; 62/138

[51] Int. Cl.[2] ..... F25C 1/12

[58] Field of Search ..... 62/137, 138

[56] References Cited

UNITED STATES PATENTS

| | | | |
|---|---|---|---|
| 2,784,563 | 3/1957 | Baker | 62/138 |
| 3,859,813 | 1/1975 | Canter | 62/138 |

*Primary Examiner*—William E. Wayner

*Attorney, Agent, or Firm*—J. C. Evans

[57] ABSTRACT

An ice maker control circuit for use with an ice maker of the type including an inclined refrigerated plate associated with means energized during an ice making cycle of operation to cause water to be continually circulated across the inclined plate as refrigerant is directed with respect thereto and wherein ice slabs built up on the plate are periodically released therefrom and directed to a cutting grid for separation into a plurality of cubes of ice; the control circuit including a bin ice accumulation switch responsive to a maximum build up of ice therein to terminate machine operation and an ice slab thickness control switch to selectively control circuit means for terminating the circulation of water over the plate and for initiating a hot gas defrost cycle of operation; the circuit further including a time delay thermal relay responsive to the bin ice accumulation switch sensing a maximum level of bin ice and operative to maintain an ice making cycle of operation until the ice slab reaches a desired thickness and thereafter conditioning a hot gas defrost solenoid to dislodge the slab from the refrigerated plate onto the grid so as to maintain the clarity of the ice slab; the thermal relay including means to maintain the hot gas defrost cycle for a time delay period followed by machine shut off.

3 Claims, 2 Drawing Figures

SLAB COMPLETION TIME DELAY RELAY

Figure 1:
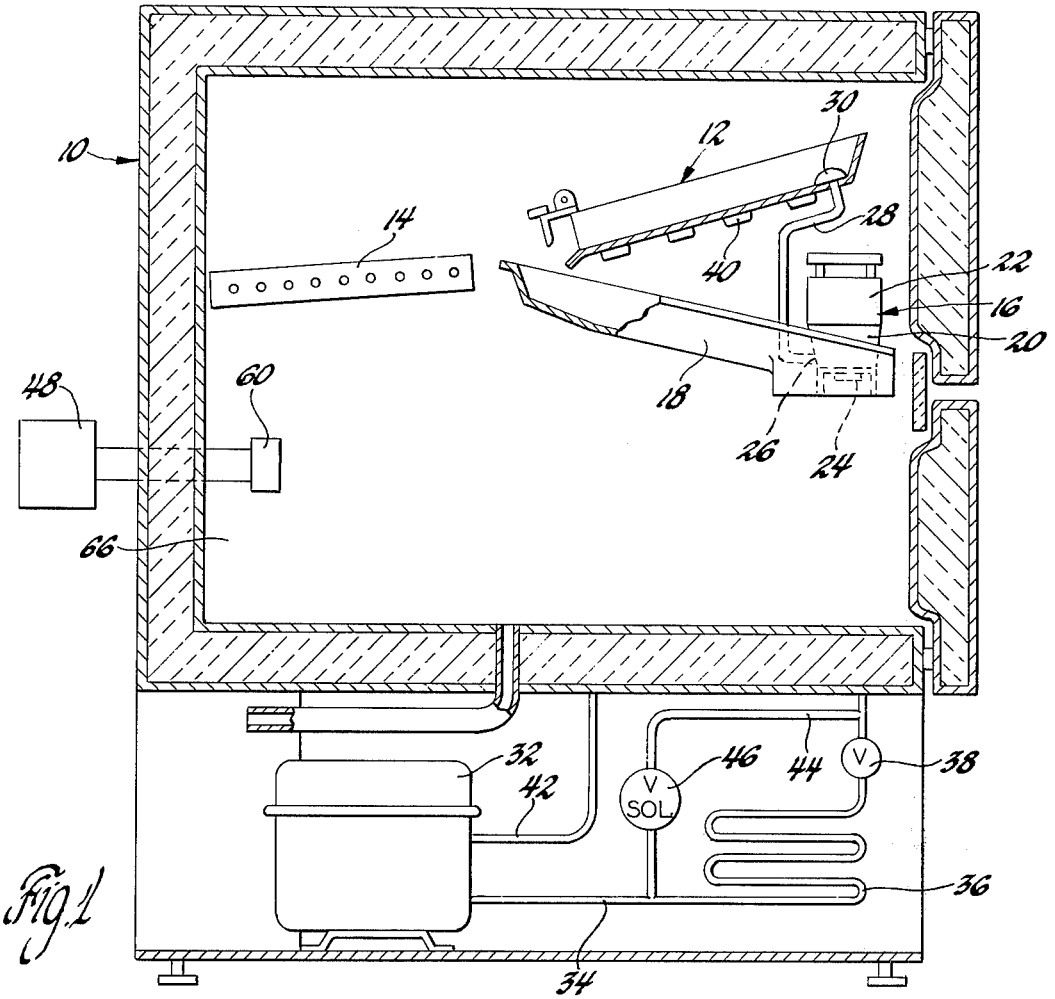

This invention relates to ice making machines and more particularly to slab type ice makers having control means for periodically controlling the release of a slab from an evaporator plate for separation into individual cubes by an electrically energized grid.

Slab type ice makers of the type set forth in U.S. Pat. No. 2,784,563 issued Mar. 12, 1957, to Baker include an inclined evaporator plate having water circulated thereacross under the control of a water pump energization circuit. Further, such machines include an electrically energized grid located below the evaporator plate and an ice accumulation bin that collects separate ice cubes from the grid for storage. In such systems the normal mode of operation includes an ice making phase of operation wherein refrigerant is directed to the evaporator plate as water is recirculated across the plate until a predetermined ice slab thickness occurs on the plate. At this point a slab thickness switch is conditioned to cause the energization circuit for the water circulating pump to terminate operation. Concurrently, a hot gas defrost system is conditioned to cause hot gas to be directed to the evaporator coil to release the slab onto the grid which is energized to separate the slab into clear ice particles for collection in the ice bin. Such systems are suitable for their intended purpose and are capable of producing large quantities of ice for collection in the bin during normal operation.

In such ice making machines, a bin switch is provided to shut down the machine when a predetermined accumulation of ice occurs in the storage bin. Frequently, at the point that this event occurs the ice slab thickness is substantially less than that which would represent a complete ice making cycle of operation during a normal mode of operation. The present way of handling such an occurrence is to include a latch type slab completion relay in the control circuit for the ice maker to maintain the ice making cycle of operation until a predetermined desired slab thickness is produced. The slab completion relay bypasses the bin thermostat switch until the slab is built up to a normal harvest thickness at which time the slab completion relay will open to terminate machine operation. Thereafter the slab is left on the evaporator plate and since the refrigerant cycle of operation is terminated eventually the temperature of the evaporator plate will be raised by surrounding ambient conditions to cause the slab to be detached from the evaporator plate for movement onto the electrically energized grid and thereafter to be divided into individual ice cube components. The release time afforded by such control is dependent upon ambient conditions, humidity and the like, and will often result in the slab being maintained on the evaporator plate for a considerable period of time. It has been observed that in such cases the quality of the ice slab deteriorates and has a lesser clarity than in the case where the ice slab is harvested by a normal progression of machine sequences including energization of a hot gas solenoid for release of the slab when the slab attains a desired thickness and when the ice bin is unfilled.

An object of the present invention is to modify existing control circuits for automatic slab type ice makers by the provision therein of thermal relay means responsive to the occurrence of a maximum build up of ice in a bin storage compartment therein to direct flow of hot gas defrost to the evaporator plate when a predetermined maximum ice buildup occurs in the bin and the ice slab reaches a predetermined thickness to release the slab for passage onto the electrically energized grid for separation thereon to individual cubes having a high degree of clarity and thereafter terminating the operation of the machine.

Still another object of the present invention is to improve the operation of a slab type ice maker including selectively energized hot gas defrost means and water pump means operated during a defrost phase of operation and during an ice making phase of operation and wherein the water pump means is controlled in part in response to bin switch means operative only upon occurrence of a maximum build up of ice particles in the storage bin of the machine to terminate machine operation; by the provision of a thermal relay circuit conditioned in response to the build up of a maximum quantity of ice in a storage bin to condition the hot gas defrost means for removing an ice slab from an inclined evaporator plate immediately upon the combined occurrence of a maximum buildup of ice in the storage bin and a build up of the slab thickness on the evaporator plate to cause it to immediately release for subsequent separation by electrically energized grid means and with the thermal relay control circuit being operative following release of the ice to terminate machine operation.

Further objects and advantages of the present invention will be apparent from the following description, reference being had to the accompanying drawings wherein a preferred embodiment of the present invention is clearly shown.

Figure 2:
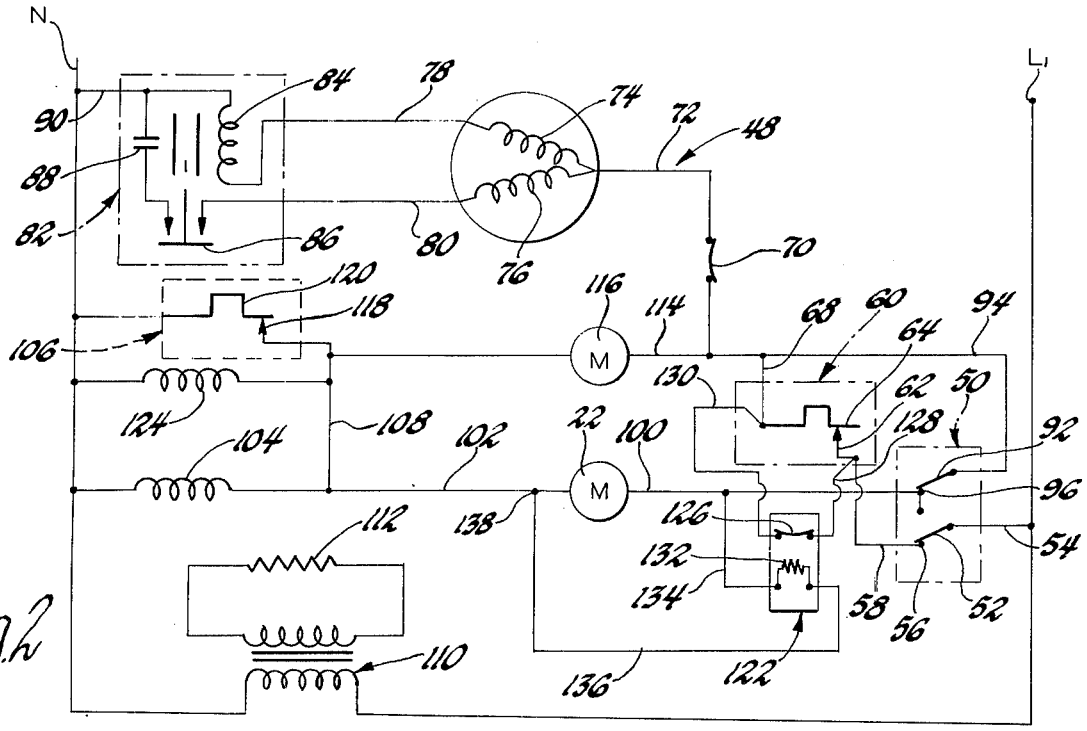

FIG. 1 is a diagrammatic view of an inclined refrigerated plate ice maker with cutting grids for separating an ice slab into individual cubes; and FIG. 2 is a circuit diagram including the electrical components of a preferred embodiment of the present invention.

Referring now to the drawing, an ice maker of the slab type is illustrated at 10 including an inclined refrigerated plate assembly 12 located above and to one side of a grid assembly 14 to receive an ice slab from the refrigerated plate assembly 12 following an ice slab formation cycle of operation thereon. During the ice making cycle a water recirculation system 16 is operated to recirculate water across the inclined refrigerated plate 12 to be frozen thereon as an ice slab that adheres to the plate 12. Water circulated during the ice making cycle of operation returns to a water reservoir 18 and is recirculated therefrom by a pump 20 driven by an electric motor 22. The water recirculation circuit is from the reservoir 18 to a pump inlet 24 thence through a pump outlet 26 and a water supply conduit 28 connected to a water distributor header 30 at the upper end of the inclined refrigerated plate assembly 12.

During the ice making or freeze cycle of operation an ice slab is built up on the plate assembly 12 by means of a refrigerant system operated to cool the plate assembly 12. More particularly, the refrigerant system includes a compressor 32 connected by an outlet conduit 34 to one end of a condenser 36 that cools hot refrigerant gas discharge from the compressor 32. The refrigerant from the condenser 36 is expanded across a suitable restrictor valve 38, or equivalent capillary tube, and the refrigerant is thence passed through an evaporator coil 40 on the bottom of the inclined refrigerated plate assembly 12 for reducing the temperature thereof below freezing. The return conduit 42 from the evaporator 40 is connected to an inlet of the compressor 32. A refrigerant circuit further includes a hot gas bypass 44 having a solenoid controlled valve 46 therein under the control of a solenoid coil to connect the outlet conduit 34 from the compressor 32 directly across the condenser 36 and restrictor valve 38 thereby to cause hot gas to flow through the evaporator coil 40 during a slab release or defrost cycle of operation.

The above illustrated ice maker 10 is representative of automatic ice making apparatus of a type more particularly set forth in the aforementioned Baker patent wherein detailed explanation of the configuration and component parts of such ice makers is more specifically set forth. The above explanation, however, will suffice for an understanding of the control circuit of the present invention.

Referring now to FIG. 2, a control circuit 48 is illustrated which includes a 115 volt power supply indicated by lines L-1 and N. The circuit includes a double pole, double throw service switch 50 having a first movable contact 52 connected by a conductor 54 to line L-1. Contact 52 is engageable with a first fixed contact 56 connected by a conductor 58 to an ice collection bin thermostat switch 60 having a fixed contact 62 and a thermally responsive movable contact 64. The bin thermostat switch 60 is maintained normally closed until a predetermined level of ice is accumulated in a bin storage region of ice maker 10 such as the bin storage cavity 66 shown in FIG. 1. A conductor 68 electricly connects the movable contact of the thermostat 60 to one side of an overload thermostat 70 that is electrically connected by means of a conductor 72 to the electric motor windings 74, 76 of the electrically motor driven compressor 32. Leads 78, 80 from the motor windings 74, 76, respectively, are connected to a conventional motor start relay 82 that includes a coil 84 and a movable contact 86 that is connected in series with a motor start capacitor 88 which in turn is connected by a conductor 90 to line N.

Additionally the circuit includes an energization circuit for the water pump drive motor 22 which is electrically connected from movable contact 92 of service switch 50 that is in series connection with the bin thermostat 60 by a conductor 94. The movable contact 92 is connected to a fixed contact 96 of switch 50 electrically connected to a conductor 100 to one terminal of the pump motor 22. Its opposite terminal is electrically connected by a conductor 102 to a water inlet solenoid valve 104 for controlling initial fill of water to the machine. Thereafter, the water level is under the control of solenoid 104 to terminate water fill when there is a desired charge of water in the recirculation system 16. The water pump energization is further under the control of an ice thickness sensor switch 106 in series with conductor 102 via conductor 108 to line N.

Additionally, the circuit includes a transformer 110 having its primary coil connected across lines L-1, N and its secondary coil connected in circuit relationship with a grid heater 112 for dividing ice slabs from the refrigerated plate 12 into individual cubes.

The circuit still further includes a condenser fan circuit including a conductor 114 to connect a condenser fan motor 116 between switch 60 and switch 106. A conductor 114 is electrically connected to a fixed contact 118 of the ice thickness control switch 106. A movable contact 120 of sensor switch 106 that will move out of engagement with fixed contact 118 when a desired ice thickness occurs to terminate condenser fan operation and water recirculation during a harvest cycle of operation.

The ice bin level control switch 60, however, operates independently of the ice thickness control switch 106. Consequently, when the ice bin level control switch 60 senses a maximum build up of ice in the bin storage cavity 66 it is possible to be part way through an ice-making cycle with the ice slab thickness being less than required to trigger switch 106.

Ice slab type ice making machines have been under the control of a latch type slab completion relay that overrides the bin level thermostat switch 60 to continue an ice making cycle of operation when the bin level thermostat switch 60 is open to terminate operation. In such cases, the ice slab thickness will continue to build up until a desired preset maximum thickness occurs. Thereafter, the machine operation is turned off and release of the slab of ice from the refrigerated plate assembly 12 is dependent upon ambient conditions which will gradually raise the temperature of the slab of ice build up on the plate assembly 12 to a point where it will be free to slip therefrom onto the grid assembly 14. However, in such cases the ice harvest is delayed in accordance with ambient conditions and it is observed that the clarity of the slab of ice can be effected under certain conditions. Accordingly, in the present invention a slab completion time delay thermal relay 122 is provided in the circuit and associated with a hot gas valve solenoid coil 124 to produce an assured release of a slab from the plate assembly 12 following the combined occurrence of a maximum build up of ice in the bin 66 and a desired build up of ice on the plate assembly 12.

More particularly, the delay thermal relay 122 is associated with the ice level control switch 60 by having a bimetallic element 126 therein having one terminal connected by a conductor 128 to the terminal of the fixed contact 62 of the switch 60. The opposite terminal of the bimetallic element 126 is connected by a conductor 130 to a terminal of switch 60 at the conductor 68. This places the bimetallic element 126 in parallel relationship to the switch 60 and in series connection with the service switch 50 so that the solenoid coil 124 for the hot gas solenoid valve 46 will be conditioned, when the movable contact 120 of switch 106 opens, to direct a flow of hot refrigerant through the evaporator coil 40 to release the slab of ice build up thereon for passage onto the grid 14. This also conditions coil 104 to operate the water fill valve to fill reservoir 18 to have a clean supply of water for further ice making cycles. The switch 106, when closed, maintains coil 124 deenergized.

By virtue of the aforesaid arrangement the completed slab of ice is released without reliance on ambient conditions so it will have a desired clarity unaffected by surrounding ambient conditions heretofore relied upon for release of the ice slab from the plate assembly 12.

The thermal relay 122 includes a heater 132 connected by a conductor 134 to the conductor 100 and by a conductor 136 to a terminal 138 between the pump motor 22 and the coil 124. The heater 132 is always energized when switch 106 is closed and the switch 60 is closed. Thus, bimetallic element 126 is heated to close and maintain machine operation. When switch 60 opens after initial operation the heater 132 keeps bimetallic element 126 closed for continued machine operation. When switch 60 is open and switch 106 then senses a desired ice build up, the heater 132 is deenergized. This reduces heat flow from heater 134 to bimetallic element 126 and following a predetermined time period, established by the cooling characteristics of element 126, the bimetallic element 126 will open thereby to terminate machine operation by disconnecting the operative components thereof from the power source. The time period delay is that required for the hot gas to cause release of the slab of ice from the refrigerated plate assembly 12.

Each time that the ice level control switch 60 indicates that there is a maximum build up of ice in the bin cavity 66 it will open and machine operation will continue under the control of the thermal relay 122. Since the hot gas valve 46 is conditioned to direct a flash of defrost gas to the coil 40 when there is a desired slab thickness buildup on the refrigerated plate assembly 12 the slab will be released while the ice still has a desired clarity onto the grid 14 for separation into individual cubes. The further ice buildup in the bin 66 will not exceed its capacity. The ice quality will remain constant. The control of the bimetallic element 126 in the relay 122 will be terminated by the reduced output of heater 132 following the hot gas flow to the plate assembly 12.

While the embodiments of the present invention, as herein disclosed, constitute a preferred form, it is to be understood that other forms might be adopted.

What is claimed is:

1. In an ice maker of the type including a mechanical compressor refrigerant system having a refrigerated surface for ice build up and water circulation means operative during an ice making mode to pass water over the refrigerated surface and further including a hot gas defrost system for directing hot refrigerant gas from the compressor to the surface to remove an ice build up therefrom for collection in a bin, the improvement comprising: first circuit means for energizing the compressor including a bin level control switch; second circuit means for energizing the water pump including said bin level control switch and a normally closed ice thickness sensor switch; third circuit for energizing the hot gas defrost system including said ice thickness sensor switch and operative to maintain the hot gas defrost system off when the ice thickness sensor switch is closed; a thermal relay switch having a bimetallic element and a heater; means including said ice thickness sensor switch for maintaining said heater energized to bias said bimetallic element closed during an ice making mode of operation wherein the bin level switch has detected a maximum ice level in the bin, said closed bimetallic element bypassing said bin level control switch to maintain the compressor and water circulation means operative following a build up of a maximum level of ice in the bin; said ice thickness sensor switch being responsive to a desired ice build up to terminate water circulation and to condition said third circuit means to initiate a defrost cycle of operation; said heater being conditioned during the defrost cycle of operation to reduce heat flow to the closed bimetallic element to produce a time delayed energization of said hot gas defrost system through the element dependent upon the cool down characteristics of said bimetallic element to produce a flow of hot gas across the refrigerated surface to cause release of the ice build up therefrom, said bimetallic element opening following the predetermined time delay to concurrently terminate the defrost cycle and maintain deenergization of the compressor and water circulation means.

2. In an ice maker having an electrically driven compressor refrigerant system to cool a refrigerated surface with water circulation produced thereover by electrically energized pump means for build up of ice on the surface and including means for removing the ice for collection in an ice storage bin, the improvement comprising: first circuit means for energizing the compressor and pump means including a normally closed ice thickness sensor switch and a bin level switch means responsive to ice accumulation within the bin, a thermal delay relay being operative to bypass the bin level switch means immediately upon build up of a predetermined ice level in the bin, said thermal delay relay including a bimetallic element and heater means for directing heat to close said bimetallic element, said bimetallic element being located in shunt relationship to the bin level switch means and in series connection with said normally closed ice thickness sensor switch to maintain the compressor and pump means operative following maximum ice build up in the bin, said heater means being electrically connected with said first circuit means to produce a first predetermined heat flow to the bimetallic element upon opening of said bin switch means to keep it closed for maintaining said compressor and pump means energized defrost means energized across said bimetallic element when a predetermined ice thickness is sensed by said ice thickness sensor switch to remove the slab from the refrigerated surface, said defrost means including means electrically connected to said heater means to reduce heat output therefrom to produce a time delay energization of said defrost means to maintain a flow of heat to the refrigerated surface for release of the ice therefrom, thereby to direct fresh ice with a desired clarity into the bin at the end of each of the ice bin fill cycles of operation, said bimetallic disc being responsive to reduced heat output from said heater means to terminate machine operation following a predetermined time delay.

3. In a slab type ice maker having an electrically driven compressor refrigerant system to cool an evaporator plate having water circulated thereover by electrically energized pump means during an ice making mode of operation to cause a build up of an ice slab on the plate; the maker further having an electrically energized grid located below the plate for receiving an ice slab therefrom for subsequent division into individual cubes to be received in an ice storage bin located below the grid, the improvement comprising: first circuit means for maintaining the pump means energized during an ice making cycle of operation; hot gas defrost means including a hot gas solenoid operative to direct hot gas from the compressor through the evaporator plate for removing an ice accumulation thereon; said first circuit means including means for maintaining said hot gas solenoid conditioned to prevent the flow of hot gas through the evaporator during the ice making cycle of operation, said first circuit means including a bin ice level switch for detecting a maximum buildup of ice therein and operative to maintain said first circuit means energized during the ice making cycle; said bin ice level switch being responsive to the predetermined maximum level of ice buildup in the bin to condition said first circuit means to terminate machine operation; second circuit means including an ice slab thickness switch and a thermal relay switch operative in response to such conditioning of said bin ice level switch to complete an energization circuit for said pump means to maintain normal machine operation until a desired slab thickness is produced, said thermal relay switch operative to cause the hot gas solenoid valve to defrost the slab for a predetermined period of time when the ice slab thickness switch senses a desired slab thickness thereby to separate an ice slab from the evaporator plate at the occurrence of a maximum ice build up in the bin and to cause the ice slab to be directed onto the grid for separation into separate cubes for accumulation in the bin at a level above the predetermined maximum level therein, said time delay means being operative to condition said first switch means and said hot gas solenoid to terminate operation of the machine once the remainder of the ice on the slab has been deposited in the bin following a maximum build up of ice therein thereby to maintain a high degree of ice cube clarity in the bin at the end of each cycle of maximum ice build up therein.

* * * * *

UNITED STATES PATENT AND TRADEMARK OFFICE

CERTIFICATE OF CORRECTION

PATENT NO. : 3,962,883
DATED : June 15, 1976
INVENTOR(S) : Robert Smith

It is certified that error appears in the above-identified patent and that said Letters Patent are hereby corrected as shown below:

Column 5, line 43, "third circuit for" should read --third circuit means for--.

Signed and Sealed this

Seventh Day of September 1976

[SEAL]

*Attest:*

RUTH C. MASON
*Attesting Officer*

C. MARSHALL DANN
*Commissioner of Patents and Trademarks*